United States Patent [19]

Liebman et al.

[11] 4,265,159

[45] May 5, 1981

[54] COLOR ORGAN

[76] Inventors: Theodore Liebman, 8201 Henry Ave., Philadelphia, Pa. 19128; Robert V. Nemiroff, 9728 Walley Ave., Philadelphia, Pa. 19115

[21] Appl. No.: 959,889

[22] Filed: Nov. 13, 1978

[51] Int. Cl.[3] ..... G08B 5/38

[52] U.S. Cl. ..... 84/464 R; 340/148; 340/366 B

[58] Field of Search ..... 84/464, DIG. 17; 362/367, 806, 811; 330/141, 127, 128, 129; 340/366 B, 148

[56] References Cited

U.S. PATENT DOCUMENTS

| | | | |
|---|---|---|---|
| 3,241,419 | 3/1966 | Gracey | 84/464 |
| 3,798,638 | 3/1974 | Goldschmed | 340/366 B |
| 3,806,919 | 4/1974 | Comey | 340/366 B |
| 3,868,501 | 2/1975 | Barbour | 362/811 |
| 3,904,866 | 9/1975 | Hayes | 362/811 |
| 3,924,231 | 12/1975 | McClure | 340/366 B |

*Primary Examiner*—Joseph W. Hartary
*Assistant Examiner*—S. D. Schreyer
*Attorney, Agent, or Firm*—I. Michael Bak-Boychuk

[57] ABSTRACT

A sound responsive color organ includes a transducer to convert sound to electricity, an amplifier to increase the level of electricity, and an automatic gain control that operates under the influence of a time dependent circuit to control the output level of the amplifier. The time dependent circuit operates at one rate when increasing the amplifier gain and at a second rate when decreasing the amplifier gain. A network is included to adjust the frequency response of the amplifier to predetermined limits. The amplifier output is used to control switching devices that turn on and/or off lights in a display located behind color masks. Located in front of the color masks is a lenticular surface which further affects the light sources to yield geometric patterns comprising the effect of the masks and the lens types.

6 Claims, 3 Drawing Figures

COLOR ORGAN

BACKGROUND OF THE INVENTION

1. Field of the Invention

The present invention relates to audio responsive devices, and more particularly to audio responsive color generators sometimes referred to as color organs.

2. Description of the Prior Art

Color generators or organs have been frequently used in the past either to provide entertainment or to serve as an advertising medium. In recent past the use of audio coupling has become quite prevalent and color organs coupled to sound are now easily found in the market place. Most frequently an audio transducer is used to provide the coupling, the organ including amplitude and frequency selection features which, by adjustment, are set to respond to the audio signal and to turn on lights. Typically devices of this kind operate on a threshold principle; the loudness of the received audio signal determining the setting of the light. The difficulty however, arises in the variations in loudness with each performance or song where in one instance the levels are constantly above the threshold, or alternatively, the threshold is never reached.

To overcome this problem variable gain controls have been utilized in the recent past which, according to the average signal, effectively vary the threshold. Gain control of this kind, however, also has some undesired features since it takes the same time constant to increase the gain as it takes for a decrease. Accordingly, as loudness changes within a song or performance, the response rate also changes.

SUMMARY OF THE INVENTION

Accordingly, it is the general purpose and object of the present invention to provide an audio responsive circuit for use in a color organ including gain control responsive in gain increase according to a first response rate and in gain decrease at a second rate.

Other objects of the invention are to provide a color organ having a gain control such that the amplifier gain increases at a different rate than it decreases.

Further objects of the invention are to provide an audio responsive color organ having self compensating features to reduce or eliminate the necessity of adjustment thereof.

Yet further objects of the invention are to provide a color organ wherein a color pattern and lens pattern are combined.

Briefly these and other objects are accomplished within the present invention by providing a color organ generally shaped as a rectangular cavity, one side thereof being covered by a surface having lenses formed thereon. Deployed behind the lenticular surface is a geometric color mask which is illuminated by various lights contained within the enclosure. The lights are connected to an audio responsive circuit having a sound transducer connected at the input of an operational amplifier circuit to respond to the sound. The operational amplifier includes a feed back loop completed across a transistor to form a gain control arrangement. The rate at which this gain control transistor is turned on differs from the rate of turn off. Thus the gain control characteristics vary depending on the direction thereof.

In this manner the gain control may be reset at a higher rate than the response rate thereof.

DESCRIPTION OF THE PREFERRED EMBODIMENT

Figure 1:
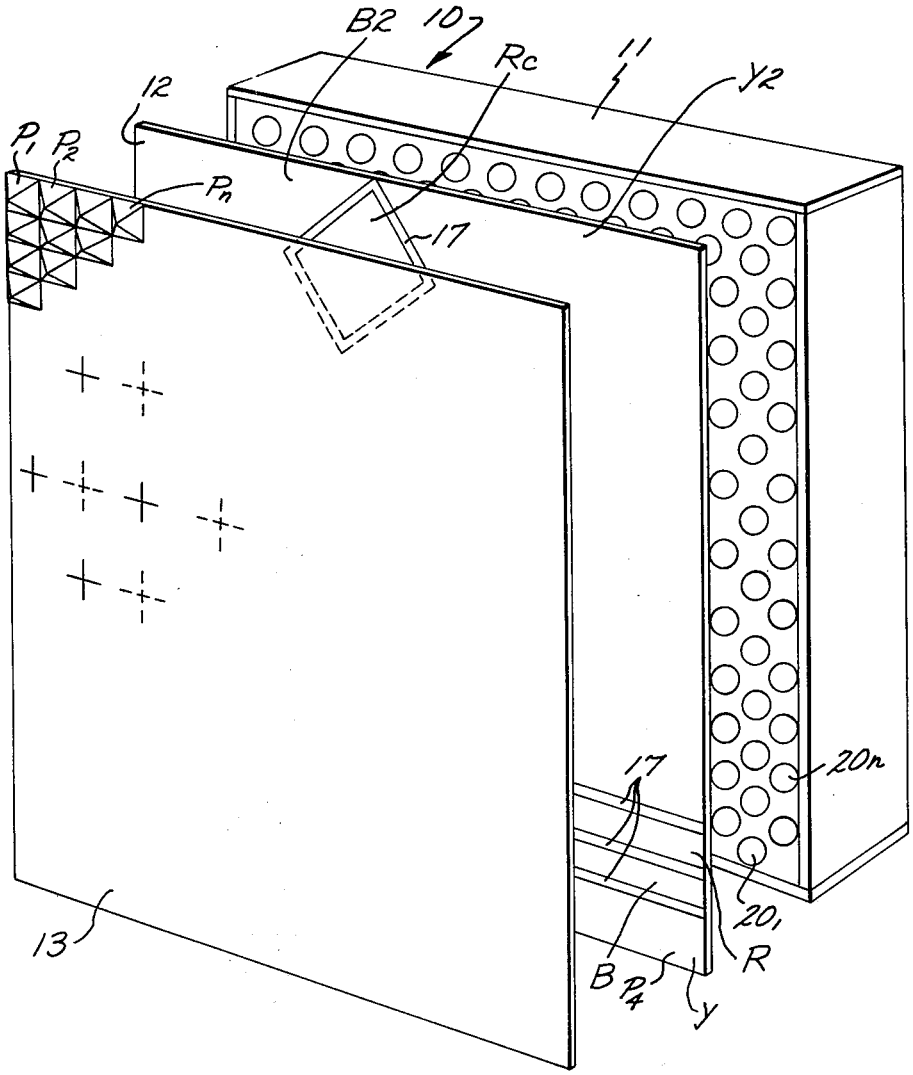
FIG. 1 is a perspective illustration of a color organ constructed according to the present invention.
Figure 2:
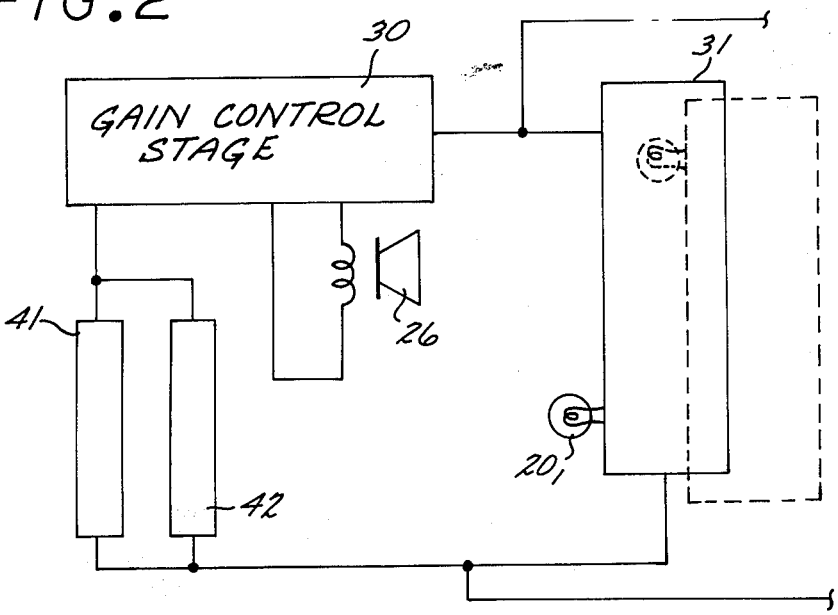
FIG. 2 is a diagrammatic illustration incorporating the general features of the invention herein.

As shown in FIG. 1 the inventive color organ, generally designated by the numeral 10, comprises a rectangular housing 11 having an open side covered first by a color mask 12 and a lenticular diffuser panel 13 spaced on the exterior thereof. Panel 13 may be made of any translucent plastic cast to include a plurality of lenses 15 arranged in patterns on the face thereof. The mask 12 is similarly translucent having geometric arrangement of colors deposited thereon.

More specifically, the mask may include color bars shown as a red bar R, blue bar B, and yellow bar Y, separated by opaque strips 17, or other geometric patterns Rc, B2 and Y2 similarly separated by geometric opaque separators 18. The color mask of either form is deployed over a bank of lights $20_1$ to $20_n$ mounted on the back surface of enclosure 11 which at the face of the panel 13 are refracted to form diamond shaped patterns P1, P2 to Pn.

Figure 3:
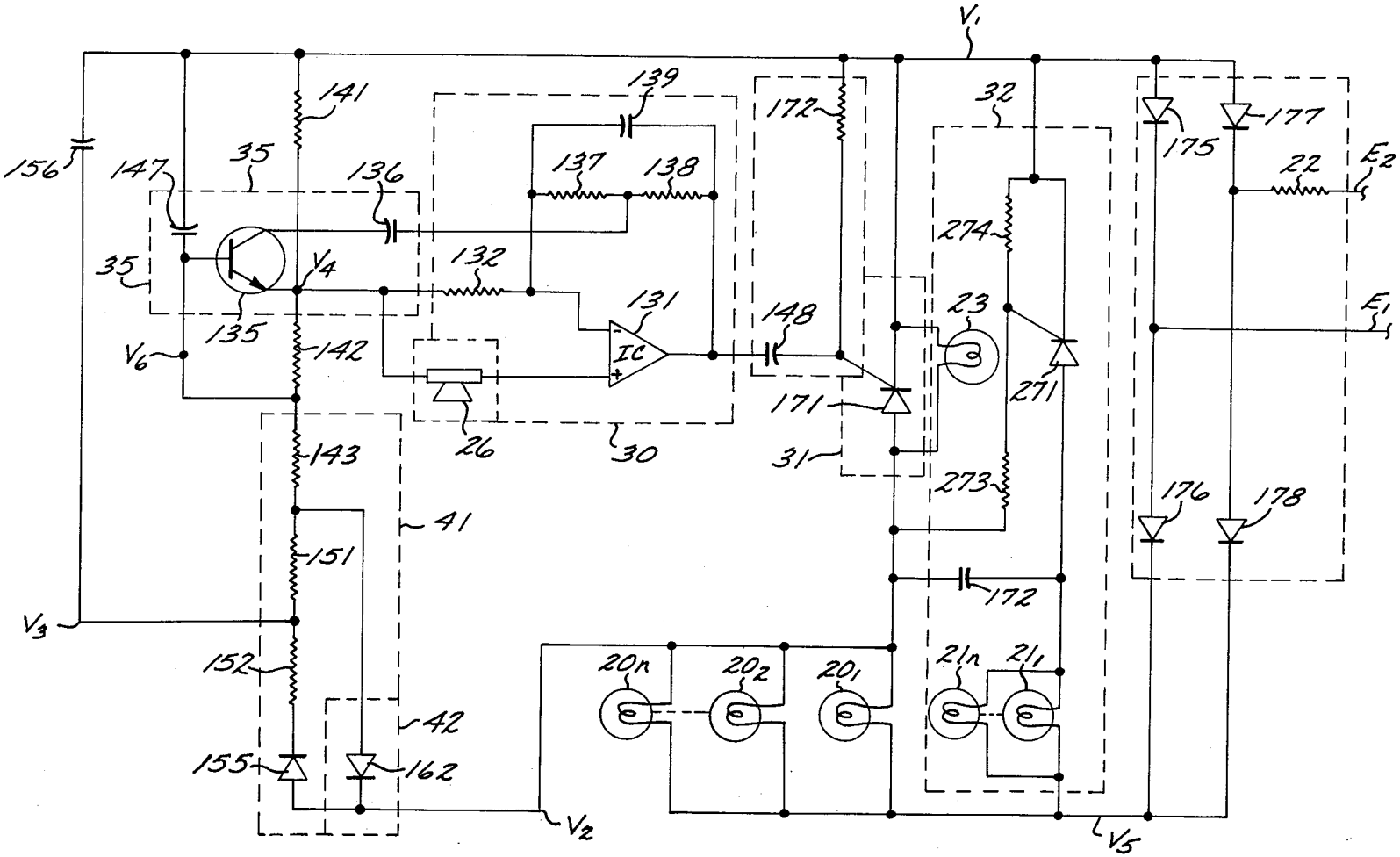
FIG. 3 is a circuit diagram illustrating an audio coupling circuit constructed according to the present invention.

As shown in more detail in FIG. 3, the gain stage 30 is built around an operational amplifier 131 having one end of microphone 26 tied to one of its inputs and the gain feedback network connected to the other input. The other end of microphone 26 and feedback network resistor 132 are connected to Voltage reference point V4 which is maintained at some positive voltage with respect to V1 by the divider network composed of Resistors 141 and 142. This serves to keep the steady state D.C. output voltage of the amplifier positive with respect to V1 to prevent saturation.

Resistor 132 in combination with resistors 137 and 138 forms a feedback network to control the D.C. gain of amplifier 131. Capacitor 139 is used to control the high frequency response of the amplifier while capacitor 148 and resistor 172 control the low frequency response.

The A.C. gain of the amplifier is controlled by transistor 135 connected to the junction of resistors 137 and 138 in the gain feedback network through D.C. blocking capacitor 136. The emitter of transistor 135 is connected to voltage reference point V4 shunting the A.C. negative feedback away from the amplifier thereby increasing the A.C. gain.

The output of the gain circuit is fed to the gate terminal of silicon controlled rectifier 171 which is the output switch. When S.C.R. 171 turns on, voltage point V2 is connected to voltage point V1 and lamps $20_1$ to $20_n$ light.

When S.C.R. 171 is off, voltage point V2 is held at the same positive voltage as point V5 through the low resistance of the lamps $20_1$–$20_n$. The positive voltage V2 passes through diode 155 and resistor 152 to charge power supply capacitor 156 to the predetermined level V3. Gain control capacitor 147 is charged to its working level of V6 from voltage point V3 through resistors 143 and 151. Voltage V6 supplies the resistor divider formed by resistors 142 and 141. The voltage drop across resistor 142 appears at the base to emitter junction of transistor 135 causing it to turn on thereby increasing the gain of amplifier 131 to its maximum setting.

When S.C.R. 171 is on, voltage point V2 is held at the same level as V1. Power supply capacitor 156 then discharges through resistor 151 and diode 162 while gain control capacitor 147 discharges through resistor 143 and diode 162.

The voltage at points V3 and V4 is determined by the amount of time S.C.R. 171 is on and off. The rate of increase of V3 and V4 is different from the rate of decrease due to the two different paths 41 and 42. Also, the rate of increase and decrease of V3 is different from the rate of increase and decrease of V4.

Lamp 23 can be added across silicon controlled rectifier 171 so that it is lit when silicon controlled rectifier 171 and lamps $20_1$ to $20_n$ are off. This gives an alternate flashing effect with lamp 23 being lit when lamps $20_1$ to $20_n$ are out and lamp 23 being out when lamps $20_1$ to $20_n$ are lit. Lamp 23 must be of a wattage equal to or less than one fourth the total wattage of lamps $20_1$ to $20_n$, or lamps $20_1$ to $20_n$ will stay lit.

When higher wattages are required in place of lamp 23, a second power switch circuit 32 is used.

Silicon controlled rectifier 271 is turned on through the voltage divider composed of resistors 273 and 274 from voltage point V2. When silicon controlled rectifier 171 is off, point V2 is at the positive potential of point V5 allowing current to flow through resistor 273 turning silicon controlled rectifier 271 on. When silicon controlled rectifier 171 is on, point V2 is at the ground potential V1 allowing no current to flow into resistor 273 thereby holding silicon controlled rectifier 271 off. When silicon controlled rectifier 171 turns on in mid cycle, silicon controlled rectifier 271 may already be on. Capacitor 172 then commutates Silicon Controlled rectifier 271 off. Lamps $21_1$ to $21_n$ then work in the same manner as described for lamp 23.

The circuit receives its power from the standard A.C. line through points E1 and E2. Resistor 22 acts to limit the peak current to the output switches 171 and 172 to a safe value protecting them from failure. Resistor 22 also acts as a fuse in case of a short circuit in the lamps or wiring. The output switching arrangement may be alternatively implemented by using several silicon controlled rectifiers in place of the single silicon controlled rectifier 171, each being connected to the amplifier output through different values of capacitor 148 allowing each to respond to a different frequency range.

Obviously many modifications and variations may be made to the foregoing description without departing from the spirit of the invention. It is therefore intended that the scope of the invention be determined solely on the claims appended hereto.

What is claimed is:

1. In a color organ having a plurality of lights mounted in an enclosure, said enclosure including a color mask mounted over said lights, the improvement comprising:

an audio responsive switching circuit connected in circuit with said lights including a sound responsive pick up connected to a gain control stage said gain control stage including a first circuit branch rendered effective during increases in said sound and a second circuit branch rendered effective during decreases in said sound, said first and second branches having different response rates and threshold means at the output of said gain control means connected to said lights for exciting said lights when said gain control means produces an output signal above a predetermined threshold.

2. Apparatus according to claim 1 wherein:

said first and second circuit branches are connected to said gain control means for controlling the gain thereof, said first circuit branch having a different response rate than said second branch.

3. Apparatus according to claim 2 wherein:

said threshold means includes a gated rectifier in circuit with one of said lights having a gate terminal enabled by said gain control means and rectifying terminals rendered conductive by said gate terminal.

4. Apparatus according to claim 3 wherein:

said enclosure includes a first translucent surface mounted over said lights, said first translucent surface having multicolored geometric patterns deposited thereon and a second translucent surface deployed adjacent said first surface, said second translucent surface being provided with a plurality of lenses arranged for diffusing light.

5. Apparatus according to claim 4 wherein:

said lenses are conformed as triangular pyramids arranged in adjacent rows and columns on the exterior of said second surface.

6. Apparatus according to claim 4 wherein:

said surface projections are arranged and spaced, in relation to said multicolored geometric patterns, such that refracted light from several patterns joins to perform new patterns of colors different from the original patterns.

* * * * *